US008875844B2

(12) United States Patent
Janz

(10) Patent No.: US 8,875,844 B2
(45) Date of Patent: Nov. 4, 2014

(54) LIFTING DEVICE FOR STORING A PERSONAL VEHICLE ON A VEHICLE DOLLY THEREON

(76) Inventor: Murray W. Janz, St. Albert (CA)

( * ) Notice: Subject to any disclaimer, the term of this patent is extended or adjusted under 35 U.S.C. 154(b) by 426 days.

(21) Appl. No.: 13/185,639

(22) Filed: Jul. 19, 2011

(65) Prior Publication Data

US 2012/0090921 A1 Apr. 19, 2012

Related U.S. Application Data

(60) Provisional application No. 61/393,121, filed on Oct. 14, 2010.

(51) Int. Cl.
*B66F 7/28* (2006.01)
*B66D 1/60* (2006.01)

(52) U.S. Cl.
CPC .... *B66F 7/28* (2013.01); *B66D 1/60* (2013.01)
USPC ..... 187/244

(58) Field of Classification Search
CPC ..... B66F 9/02; B66F 9/06; B66B 9/16
USPC ..... 187/244, 239, 203, 207, 216, 213; 182/101, 102, 148
See application file for complete search history.

(56) References Cited

U.S. PATENT DOCUMENTS

| | | | | |
|---|---|---|---|---|
| 2,254,989 | A * | 9/1941 | Benson | 254/356 |
| 3,891,063 | A * | 6/1975 | Lucasey et al. | 187/244 |
| 4,184,570 | A | 1/1980 | Edwards | |
| 4,262,773 | A * | 4/1981 | Basham | 182/132 |
| 5,871,070 | A | 2/1999 | Contreras | |
| 6,287,069 | B1 | 9/2001 | Oliphant et al. | |
| 6,524,056 | B1 | 2/2003 | Kloster | |
| 6,676,233 | B1 | 1/2004 | Evans et al. | |
| 2002/0179181 | A1 * | 12/2002 | Murphy | 144/286.5 |
| 2011/0170992 | A1 * | 7/2011 | Rosenthal | 414/258 |

* cited by examiner

*Primary Examiner* — William E Dondero
*Assistant Examiner* — Diem Tran
(74) *Attorney, Agent, or Firm* — Ryan W. Dupuis; Kyle R. Satterthwaite; Ade & Company Inc.

(57) ABSTRACT

A lifting device has a lifting track mounted on a wall and a carriage with a lift frame movable along the track. A dolly with wheels at opposing ends is arranged to support various cargo thereon including personal vehicles such as motorcycles or snowmobiles or other comparably sized objects. The lift frame of the carriage has lift forks arranged to be received a wheel track of the dolly which receives wheels of a personal vehicle thereon. Guide flanges alongside the lifting track are engaged by upper and lower guide followers to prevent binding of the lift frame along the lifting track. The dolly includes longitudinal rails mountable at different lateral distances to accommodate different vehicle wheel configurations.

15 Claims, 9 Drawing Sheets

LIFTING DEVICE FOR STORING A PERSONAL VEHICLE ON A VEHICLE DOLLY THEREON

This application claims the benefit under 35 U.S.C.119(e) of U.S. provisional application Ser. No. 61/393,121, filed Oct. 14, 2010.

FIELD OF THE INVENTION

The present invention relates to a lifting device which is suitable for lifting a personal vehicle on a vehicle dolly thereon, and more particularly, the present invention relates to a lifting device including a carriage having track followers for movement along a track and guide followers for guiding alignment of the track followers. Furthermore, the present invention relates to a vehicle dolly which is adjustable for accommodating different types of person vehicles thereon while being readily supported on the lifting device.

BACKGROUND

In storage areas, for example garages and the like, it is desirable to maximize the use of storage space. To accomplish this, it is desirable to store some objects raised above the floor so that additional objects can be stored therebeneath. Examples of lifting devices related to this purpose include U.S. Pat. No. 6,676,233 by Evans et al., U.S. Pat. No. 5,871,070 by Contreras and U.S. Pat. No. 4,184,570 by Edwards. Each of the disclosed devices has some restriction to loading of cargo onto the lifting frame such that the devices are not well suited for readily supporting personal vehicles thereon such as motorcycles, riding mowers, all terrain vehicles and the like.

Vehicle dollies are known for simplifying the transport and handling of personal vehicles, however, the lifting devices described in the above noted patents are not well suited for accommodating known dolly designs. Examples of two motorcycle dollies are disclosed in U.S. Pat. No. 6,287,069 by Oliphant et al and U.S. Pat. No. 6,524,056 by Kloster. Neither of the motorcycle dollies disclosed can be adapted to other vehicle types in an efficient manner nor can known lift designs readily accommodate them.

SUMMARY OF THE INVENTION

According to one aspect of the invention there is provided a lifting device in combination with a vehicle dolly for a personal vehicle wherein the vehicle dolly comprises a dolly frame including at least one wheel track extending in a longitudinal direction between opposing ends of the dolly frame supported on wheels such that the dolly frame is supported for rolling movement along the ground in which said at least one wheel track is arranged for receiving wheels of the personal vehicle rolled thereon, the lifting device comprising:

a mounting frame arranged to be supported on an upright supporting surface;

at least one lifting track extending vertically along the mounting frame; a carriage supported for movement along said at least one lifting track between a lowered position in which a bottom end of the carriage is adjacent to a bottom end of the mounting frame and a raised position in which the bottom end of the carriage is spaced upwardly from the bottom end of the mounting frame;

a lift frame fixed on the carriage for movement therewith along said at least one lifting track, the lift frame extending generally horizontally outward from the bottom end of the carriage so as to be arranged to be received below the said at least one wheel track at a location between the wheels at the opposing ends of the dolly frame.

By providing a lift frame which can be readily accommodated between the wheels of a personal vehicle dolly, the personal vehicle can be readily stored in a raised position relative to the upright supporting wall of a garage or other storage area for example. By arranging the configuration of the carriage to comprise upper and lower track wheels as well as upper and lower guide wheels, the carriage is readily supported for rolling movement along the mounting frame of the lifting device while accommodating very large loads without concern for binding of the carriage relative to the mounting frame. By further providing a lifting frame comprising lifting forks adapted to support a pallet thereon many additional types of cargo can be readily supported on the carriage. the arrangement of the dolly to include rails arranged to be mounted in a first configuration defining a single track or a second configuration defining a pair of tracks allows the dolly to be readily adjusted to accommodate different types of vehicles, including single track motorcycles or dual track all terrain vehicles and riding mowers and the like.

The lift frame may comprise a pair of parallel and spaced apart rails extending perpendicularly outwardly from the mounting frame so as to define a lifting fork arranged for supporting a pallet thereon.

Preferably there is provided a pair of lifting tracks along opposing sides of the mounting frame.

A winch is preferably fixed to the carriage for movement therewith relative to the mounting frame and a winch cable wound onto the winch at a first end, the winch cable extending over an upper pulley supported on a top end of the mounting frame and being anchored at a second end opposite the first end wound onto the winch.

Preferably a ratchet mechanism is provided which includes a plurality of latching surfaces spaced apart in a vertical direction on the mounting frame to define a rack and a pawl pivotally supported on the carriage for pivotal movement between a locking position in which the pawl is arranged for selective engagement with the latching surfaces of the rack such that only downward movement of the carriage relative to the mounting frame is prevented and a released position in which the pawl is prevented from engaging the latching surfaces of the rack. Preferably the pawl is biased towards the locking position. A release cable is preferably coupled to the pawl at a first end and is suspended from the carriage such that pulling an opposing second end of the release cable displaces the pawl into the released position.

According to a second aspect of the present invention there is provided a lifting device comprising:

a mounting frame arranged to be supported on an upright supporting surface;

at least one lifting track extending vertically along the mounting frame, the track comprising an inner bearing surface and an outer bearing surface which are supported on the mounting frame so as to be substantially parallel to the upright supporting surface and such that the inner bearing surface faces the upright supporting surface and the outer bearing surface faces away from the upright supporting surface;

a guide flange extending vertically along the mounting frame and being oriented transversely to the bearing surfaces of said at least one track;

a carriage supported for movement along said at least one track;

an upper track follower supported adjacent a top end of the carriage and being arranged for riding along the inner bearing surface;

a lower track follower supported adjacent a bottom end of the carriage and being arranged for riding along the outer bearing surface;

a pair of upper guide followers supported adjacent the top end of the carriage and being arranged for riding along opposing sides of the guide flange;

a pair of lower guide followers supported adjacent the bottom end of the carriage and being arranged for riding along the opposing sides of the guide flange; and a lift frame fixed on the carriage for movement therewith along said at least one track, the lift frame extending generally horizontally outward so as to be arranged to support an object for lifting thereon.

Preferably the upper and lower track followers as well as the upper and lower guide followers comprise wheels supported for rolling movement along the bearing surfaces and the sides of the guide flange respectively.

Preferably the guide followers are adjustable relative to the carriage frame in a generally horizontal direction arranged to extend substantially parallel to the upright supporting surface.

Each lifting track preferably comprises a U-shaped channel defined by a first flange defining the inner bearing surface, a second flange defining the outer bearing surface and a base flange joined between the first and second flanges.

According to another aspect of the present invention there is provided a vehicle dolly for a personal vehicle, the vehicle dolly comprising:

a dolly frame extending in a longitudinal direction between opposing front and rear ends, the dolly frame comprising:

- a front frame member spanning perpendicularly to the longitudinal direction at the front end of the dolly frame;
- a rear frame member spanning perpendicularly to the longitudinal direction at the rear end of the dolly frame; and
- a pair of rails extending in the longitudinal direction between the front frame member and the rear frame member; and a pair of wheels supported on each of the front and rear frame members at spaced apart positions so as to be arranged to support the dolly frame for rolling movement along the ground;

the pair of rails being arranged to be mounted on the front and rear frame members at a first prescribed spacing so as to be arranged to define a single track arranged to receive wheels of a motorcycle driven thereon; and the pair of rails being arranged to be mounted on the front and rear frame members at a second prescribed spacing so as to be arranged to define a pair of tracks arranged to receive wheels of a personal all terrain vehicle driven thereon.

The vehicle dolly is preferably used in combination with a pair of elongate panels or boards wherein each rail is arranged to support a respective one of the elongate panels extending along a length thereof in the longitudinal direction in the second prescribed spacing of the rails to define the pair of tracks and wherein the rails are arranged to commonly support one of the elongate panels extending therealong in the longitudinal direction in the first prescribed spacing of the rails to define the single track.

The pair of rails preferably extend overtop of the front and rear frame members in an overlapping configuration therewith with the wheels comprising caster wheels having upright pivot assemblies overtop of which the front and rear frame members are supported.

When there is provided a pair of tie down anchor loops secured to each of the front and rear frame members, preferably each anchor loop being secured to the respective frame member by a common fastener with a respective one of the caster wheels.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
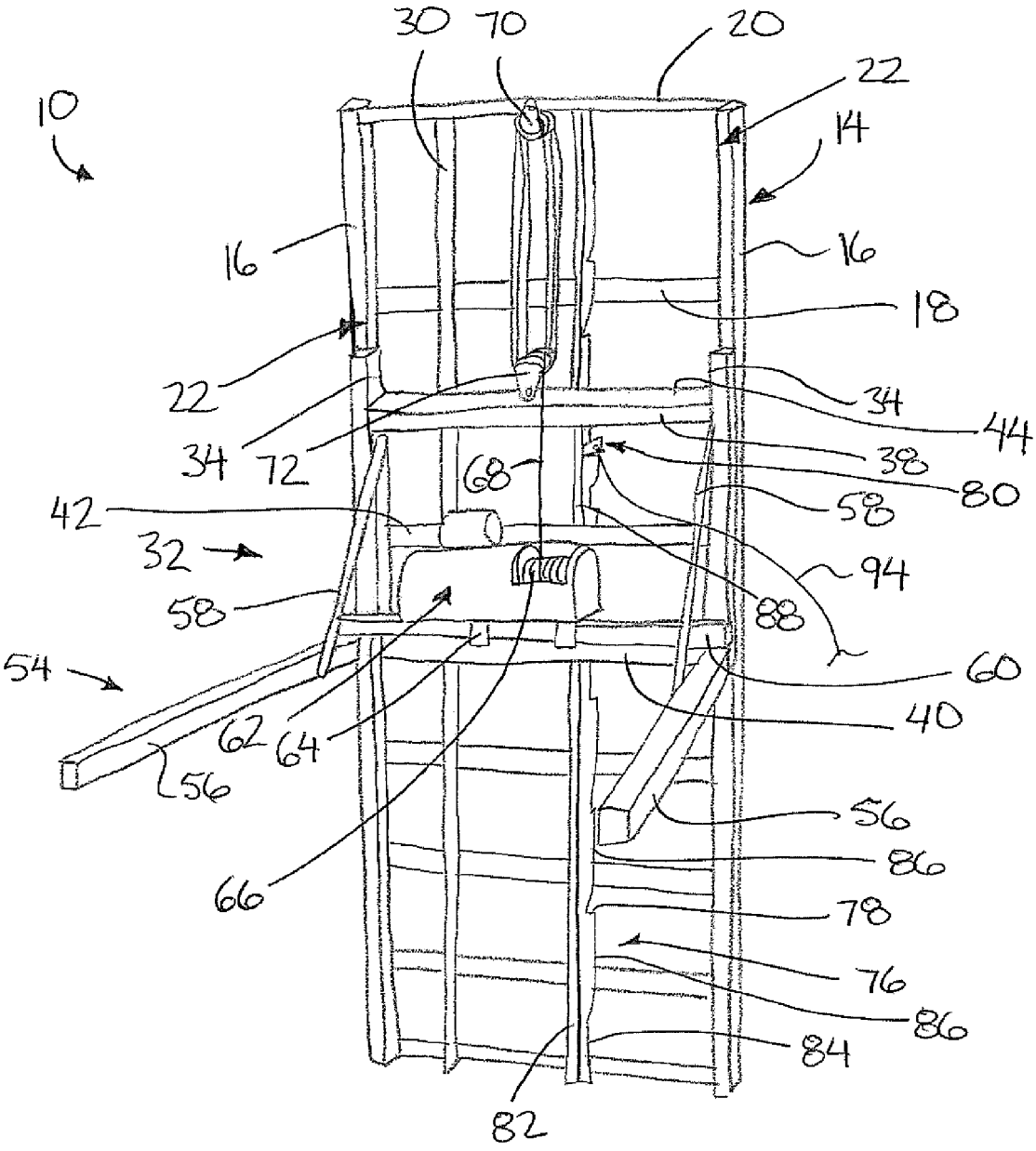
FIG. 1 is a perspective view of the lifting device.
Figure 2:
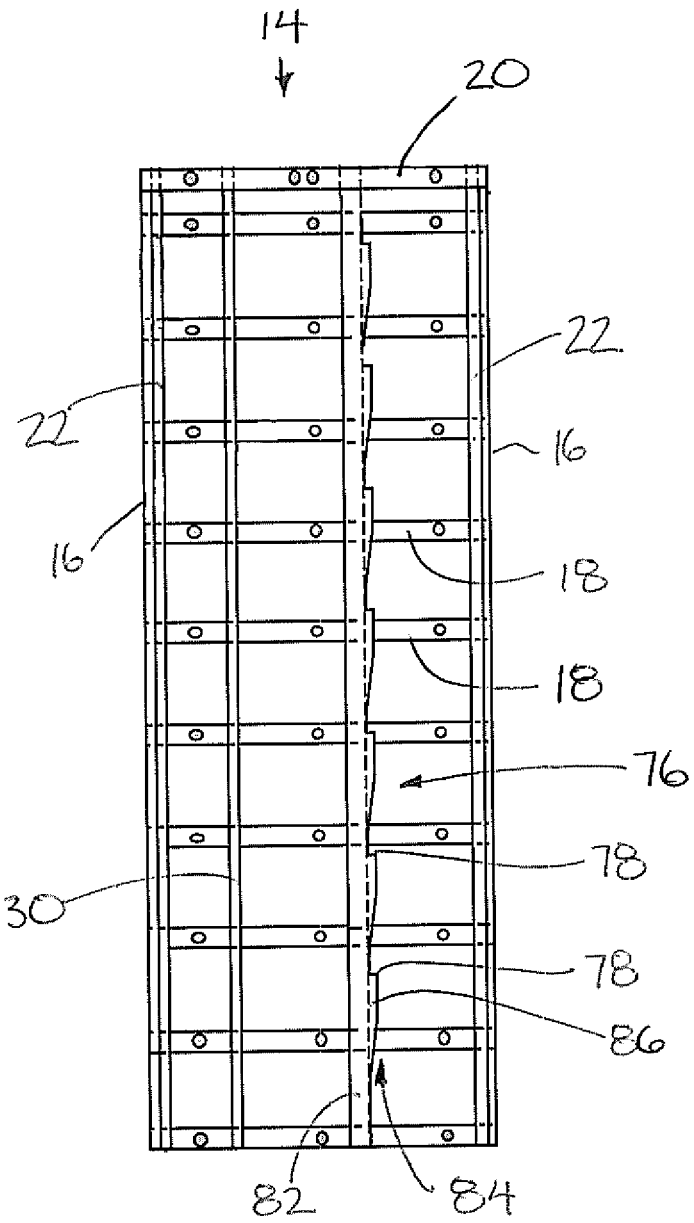
FIG. 2 is a front elevational view of the mounting frame.
Figure 3:
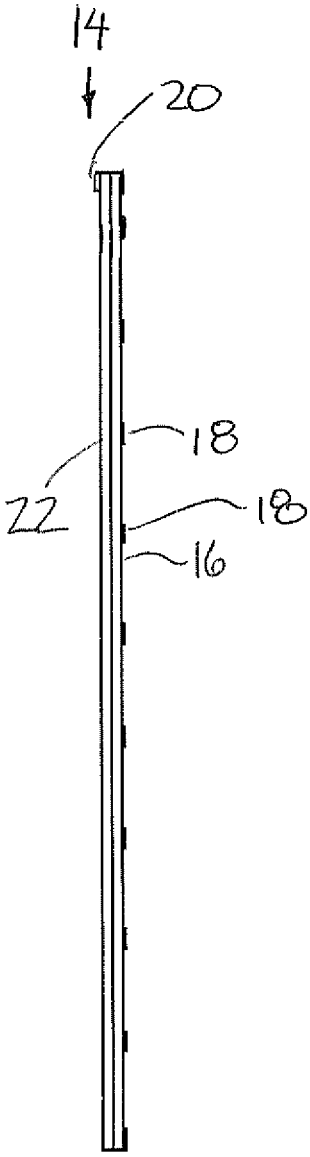
FIG. 3 is a side elevational view of the mounting frame.
Figure 4:
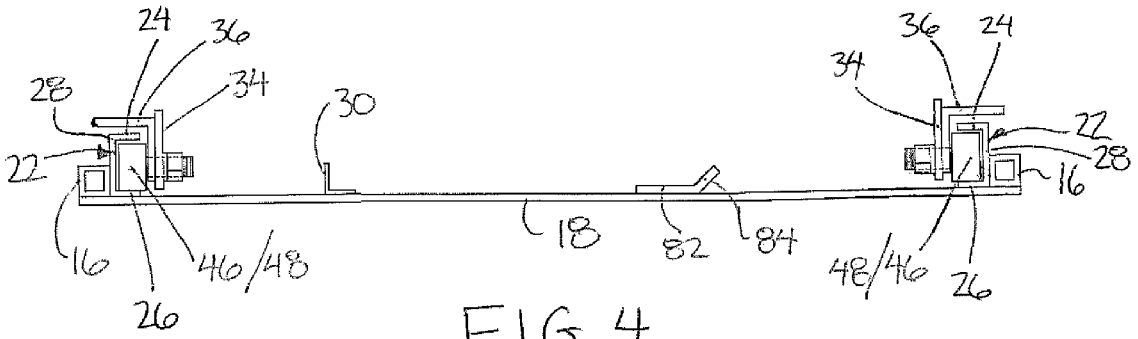
FIG. 4 is a top plan view of a portion of the carriage supported on the mounting frame.
Figure 5:
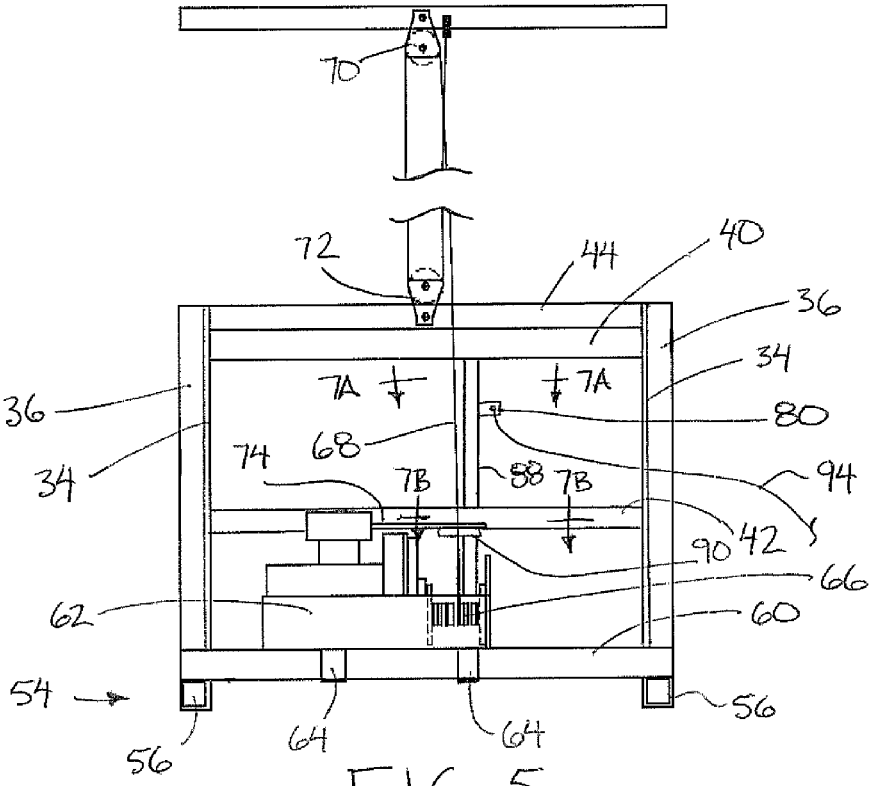
FIG. 5 is a front elevational view of the carriage.
Figure 6:
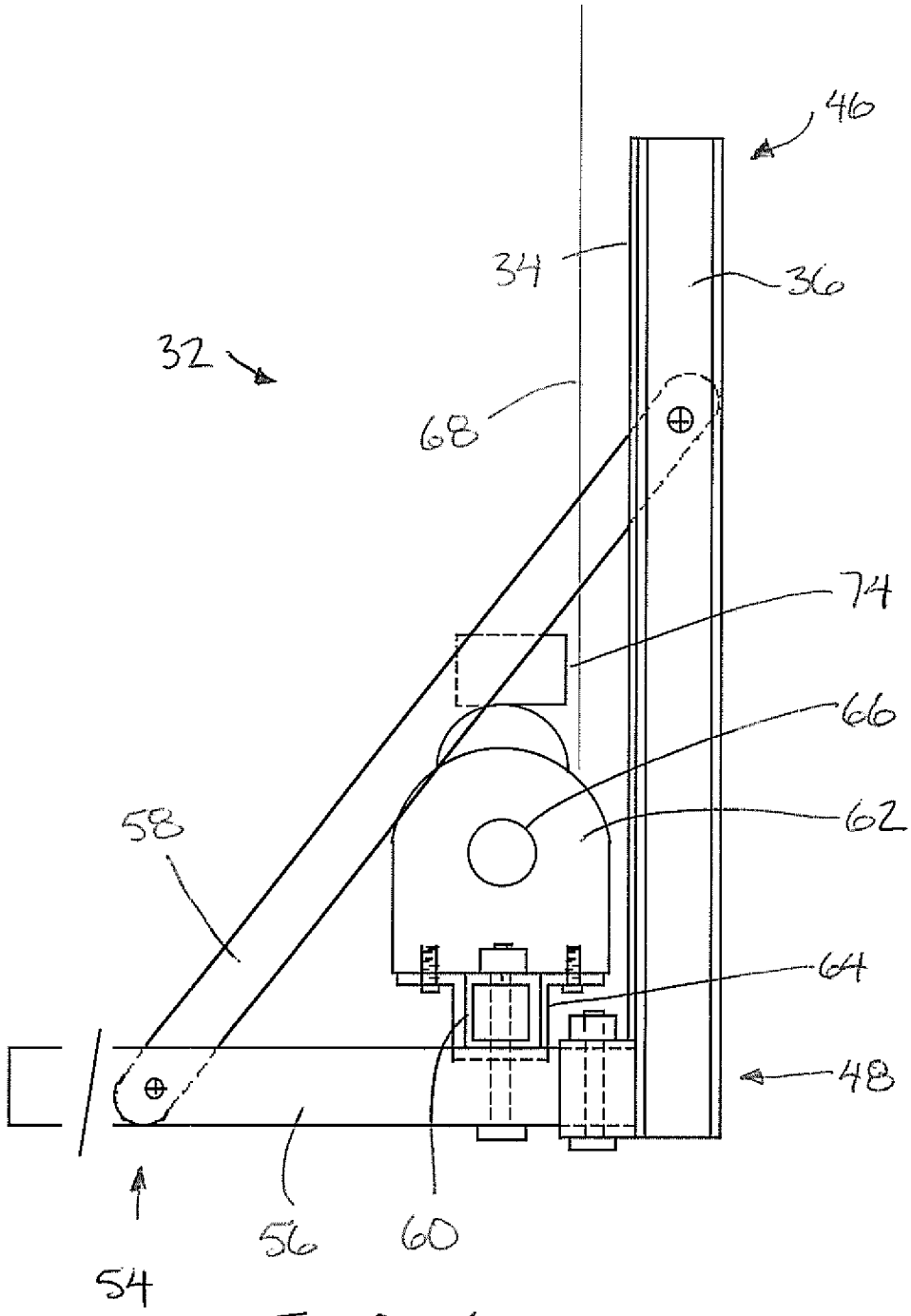
FIG. 6 is a side elevational view of the carriage.
Figure 7A:
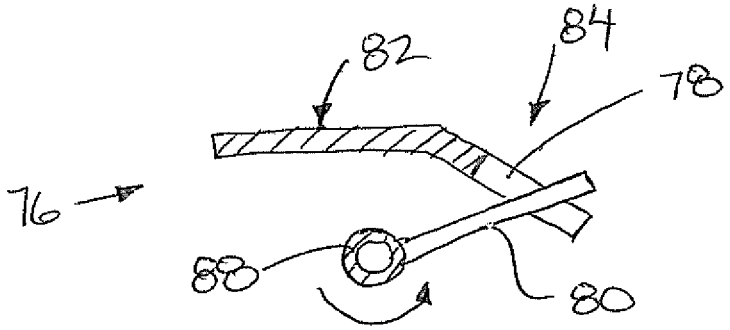
FIG. 7A is a sectional view along the line 7A-7A of FIG. 5.
Figure 7B:
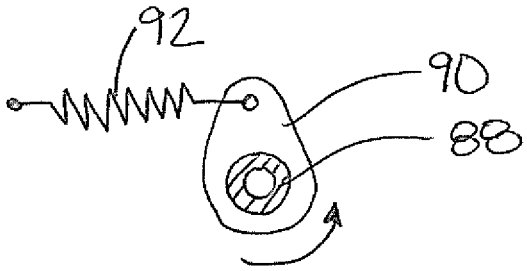
FIG. 7B is a sectional view of a portion of the ratchet mechanism along the line 7B-7B of FIG. 5.
Figure 8:
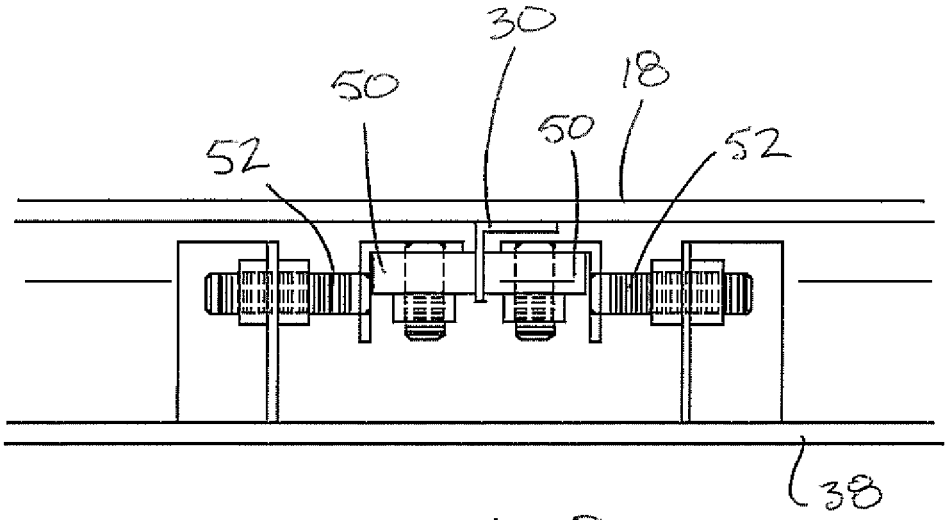
FIG. 8 is a plan view of one of the pairs of guide wheels.
Figure 9:
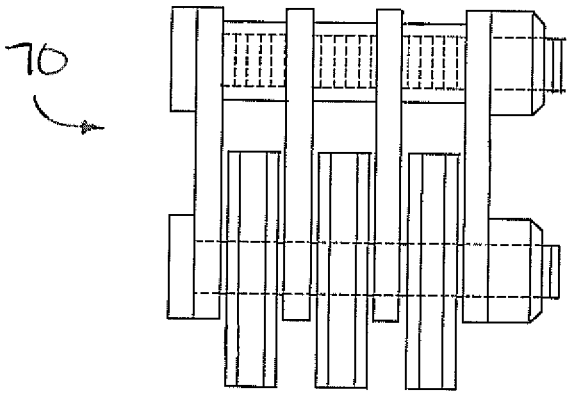
FIG. 9 is a side elevational view of the upper block of upper pulleys.
Figure 10:
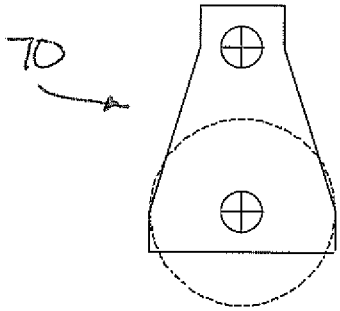
FIG. 10 is a front elevational view of the upper pulley block.
Figure 11:
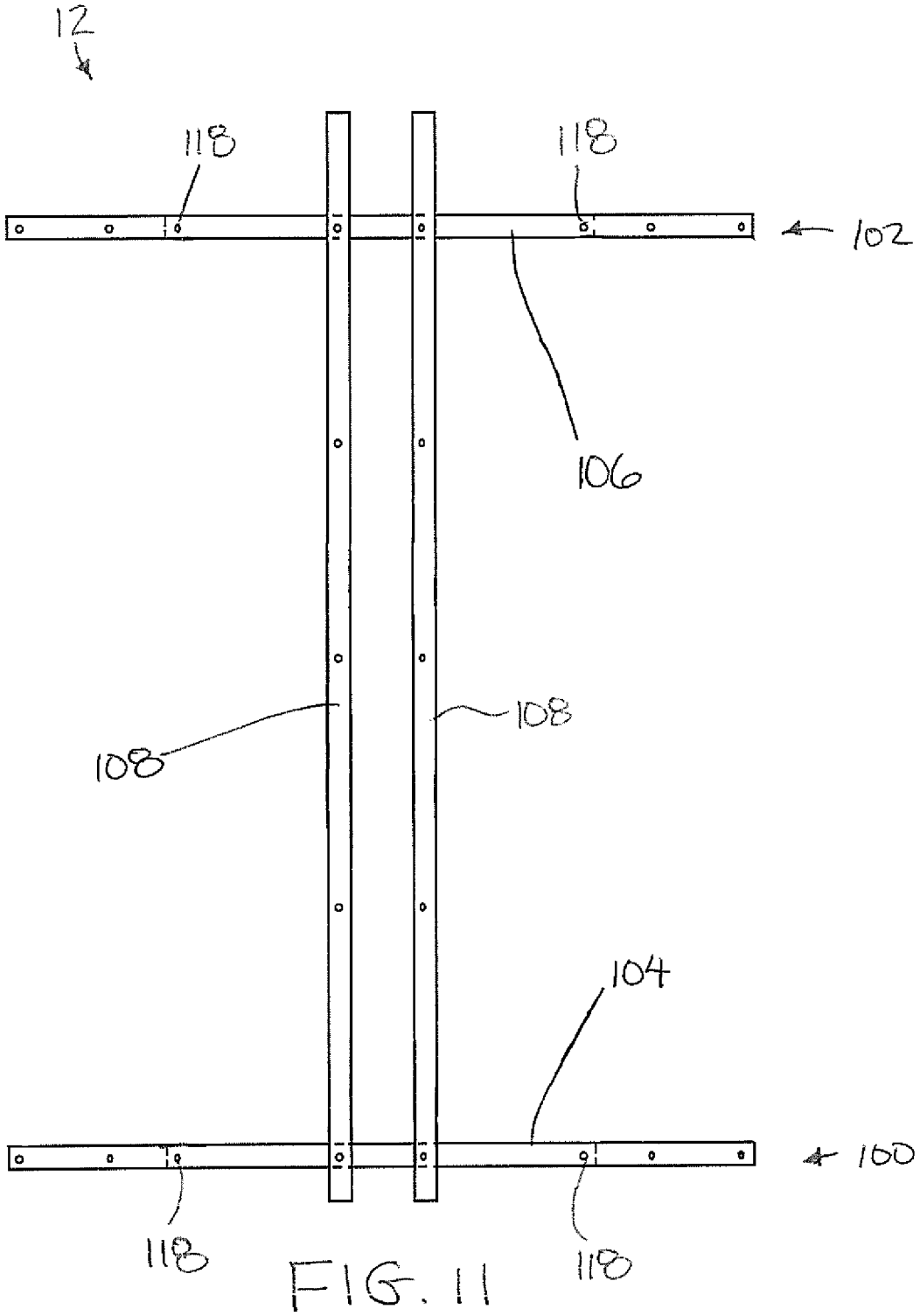
FIG. 11 is a top plan view of the dolly frame.
Figure 12:
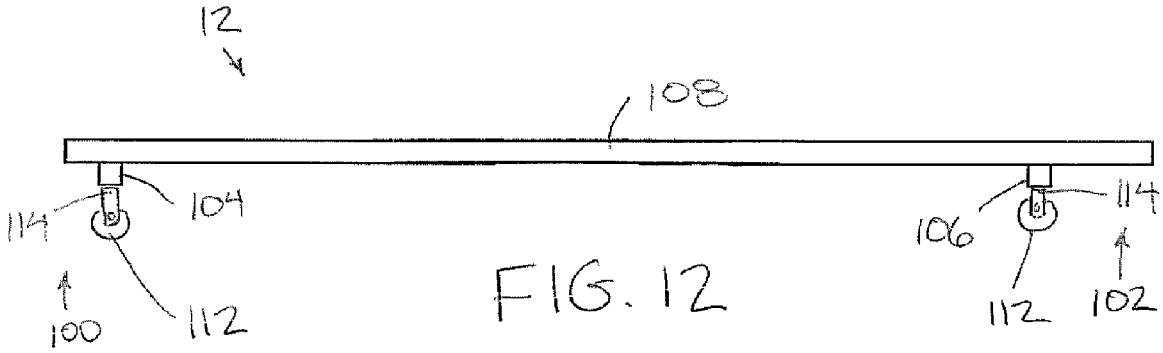
FIG. 12 is a side elevational view of the dolly frame.

Referring to the accompanying figures there is illustrated a lifting device generally indicated by reference numeral 10. The lifting device 10 is arranged for mounting onto an upright supporting surface such as the wall of a storage area. In a preferred arrangement, the lifting device is suited for use with a vehicle dolly 12 arranged to support a personal vehicle thereon, for example a motor cycle, an all terrain vehicle or a riding mower.

The lifting device includes a mounting frame 14 defining a vertical mounting plane arranged for mounting parallel against the upright supporting surface. The mounting frame 14 includes two vertical supports 16 extending in the longitudinal direction of the mounting frame along the full height thereof at two laterally opposed sides of the frame. A plurality of horizontal straps 80 of rigid material span in the lateral direction parallel to the mounting plane in fixed connection to the two vertical supports at opposing ends thereof. A crossbar 20 is also provided spanning between the two vertical supports at the top end thereof to define the top end of the mounting frame.

Two tracks 22 are provided extending adjacent respective vertical supports 16 along the opposing sides of the mounting frame. The two tracks span the full height of the mounting frame between top and bottom ends thereof. Each track 22 comprises a U-shaped channel including a first flange 24 which defines an inner bearing surface facing inwardly towards the wall and a second flange 26 defining an outer bearing surface which faces outwardly away from the wall such that the inner and outer bearing surfaces confront one another along the interior of the U-shaped channel. The first and second flanges are joined by a base flange 28 forming the outer side of the channel opposite from the opposing channel.

A guide flange 30 is joined across all of the straps 18 of the mounting frame in fixed connection therewith so as to project perpendicularly outward from the mounting plane of the frame and wall along the full height of the mounting frame. The guide flange 30 is located at an intermediate location in the lateral direction so as to be spaced inwardly from both of the tracks 22 of the mounting frame.

A carriage 32 is supported for rolling movement along the full height of the tracks 22 of the mounting frame. The carriage generally comprises two side plates 34 which are elongate in a vertical direction and which are mounted parallel and spaced apart from one another at opposing sides of the carriage. The side plates are suitably spaced such that the carriage is approximately the full width of the mounting frame while being arranged to be received in between the two tracks 22 of the mounting frame.

An angle 36 is joined to each of the two side plates to also span the full height of the carriage frame. Each angle 36 includes a first flange which is parallel to and in overlapping arrangement with the respective side plate 34 and a second flange which is perpendicular to the first flange and which extends outwardly away from the opposing side plate at the front edge of the respective side plate. In this arrangement, the second flange of the angle 36 is arranged to overlap across the front side of the respective track 22 when the two side plates are received between the tracks.

The carriage 32 further comprises an upper cross bar 38, a lower cross bar 40 and a middle cross bar 42 which span horizontally between the two side plates adjacent the top end, adjacent the bottom end and at an intermediate location therebetween respectively. The carriage frame further comprises a pulley bar 44 spanning between the top ends of the two side plates to define the top end of the carriage frame.

Two upper track followers 46 are provided on respective opposing sides of the carriage frame adjacent the top end of the carriage frame for rolling movement about a common upper axis oriented in the lateral direction. The wheels defining the upper track followers are arranged for rolling movement within respective ones of the channels forming the tracks. The upper track followers ride along the inner bearing surface when weight is supported on the carriage frame which causes a forward moment to the top end of the carriage frame which urges the upper track followers forwardly against the inner bearing surface.

The carriage similarly comprises lower track followers 48 in the form of a pair of wheels mounted on the respective sides of the carriage frame adjacent the bottom end thereof for rolling movement within respective channels forming the two tracks. The same moment applied to the carriage frame by weight supported thereon urges the lower track followers rearwardly into engagement with the bearing surface inside the channels of the tracks.

The carriage 32 is also provided with a pair of upper guide followers 50 supported on the upper cross bar adjacent the top end of the carriage. The upper guide followers each comprise a wheel with the two wheels being supported on the crossbar for alignment with the guide flange such that the upper guide followers are arranged for rolling movement along opposing sides of the guide flange as the carriage is displaced along the mounting frame between a lowered position adjacent the bottom end thereof and a raised position spaced upwardly therefrom adjacent the top end of the mounting frame.

Each guide follower 50 is supported on a respective threaded rod 42 oriented in the lateral direction such that adjustment of the threaded rod relative to the carriage frame adjusts the position of the respective guide follower 50 in the lateral direction relative to the carriage. By adjusting the position of both guide wheels, the lateral position of the carriage relative to the guide rail can be adjusted at the top end of the carriage which in turn allows for centering alignment of the upper track followers with the respective bearing surfaces of the tracks.

The carriage 32 similarly includes a pair of lower guide followers mounted on the lower cross bar using a similar configuration of threaded rods which permits adjustment in the lateral direction of the position of the guide followers. By mounting the lower guide followers adjacent the bottom end of the carriage, the position of the carriage in the lateral direction can be adjusted relative to the guide flange upon which the pair of guide rollers roll similarly to the upper guide followers so that the lower track followers 48 can be similarly aligned in the lateral direction with the respective bearing surfaces of the tracks.

The carriage includes a lift frame 54 comprised of two rails 56 which are parallel and spaced apart from one another and which project perpendicularly outward from the wall and the mounting plane of the mounting frame 14. The two rails 56 are anchored to the carriage frame adjacent the two side plates 34 at opposing sides so that the two rails 56 are spaced apart by the full width of the carriage frame so as to be suitably spaced for fitting various commercially available pallets used for transport and handling of various goods.

A pair of strap members 58 are coupled to the two rails 56 respectively to define respective gussets which provide added support to maintain the two rails in a horizontal orientation. Each strap is coupled at a top end to the respective side plate of the carriage frame nearer to the top end than the bottom end thereof while being anchored at an opposing bottom end to the respective rail 56 at a location spaced forwardly from the rear end anchored to the carriage frame. The straps 58 are anchored to the rails closer to the rear end than the forward free ends thereof so as not to interfere with loading of cargo onto the lift frame.

A winch mounting member 60 is mounted to span in the lateral direction between the two rails 56 adjacent to the rear end thereof with the opposing ends of the mounting member 60 overlapping the two rails respectively where they are fastened. A winch 62 is supported on the mounting member by a pair of clamps 64 clamped onto the mounting member at spaced apart positions in the lateral direction. The winch 62 includes an electric motor and a spool 66 onto which a winch cable 68 is wound. The first end of the cable is anchored to the spool for winding thereon. The winch lifts the carriage relative to the mount frame using the cable 68 in cooperation with an upper block comprising a plurality of upper pulleys rotatable about a common upper axis and a lower block 72 comprising a plurality of lower pulleys rotatable about a second lower axis. The upper block is connected to the cross bar 20 at the top of the mounting frame while the lower block 72 is anchored to the pulley bar 44 at the top end of the carriage frame. The cable is alternately wound about upper and lower pulleys of the upper and lower pivot blocks in a block and tackle configuration with the second end of the cable being anchored onto the pulley bar 44 of the carriage. Winding of the cable onto the spool of the winch thus causes the upper and lower blocks to be drawn together such that the top end of the carriage is lifted to the top end of the mounting frame.

The winch further includes a limit switch 74 pivotally supported on the carriage frame so as to be arranged to engage a corresponding stop on the mounting frame when the carriage reaches the top end for automatically turning off the electric motor of the winch 62 once the carriage is fully raised into the raised position.

To prevent the carriage from falling in the event of failure of the winch, a ratchet mechanism is provided which includes a rack 76 on the mounting frame defining a plurality of vertically spaced apart latching surfaces 78 and a pawl 80 pivotally supported on the carriage for cooperation with the rack 76.

The rack is defined by an elongate member comprising two flanges joined together which span vertically the full height of the mounting frame. The first flange 82 of the rack is joined parallel to the mounting plane of the mounting frame to span across the straps at an intermediate location spaced inwardly from both sides of the mounting frame. The second flange 84 is transverse to the first flange and is oriented to extend outwardly from the mounting plane at an inclination for selective engagement with the pawl 80 on the carriage.

The second flange 84 includes a forward edge which is formed to define a plurality of projections 86 at spaced positions thereon in which the top edge of each projection forms a horizontal shoulder defining a respective latching surface 78 while the bottom edge of the projection is sloped between the inner edge of one latching surface and the outer edge of another latching surface thereabove. Accordingly when the pawl 80 on the carriage is in an engaged position, the sloped bottom portion of each projection causes the pawl to ride over the projection with upward movement of the carriage relative to the mounting frame so that movement towards the raised position is not inhibited by the ratchet mechanism. Alternatively, the pawl is arranged to engage the latching surfaces 78 in a latching configuration therewith so that downward movement of the carriage relative to the mounting frame is resisted in the engaged position.

The pawl 80 is supported on a pivot shaft supported vertically on the cross bars of the carriage frame for rotation about a respective vertical axis so that the free end of the pawl is moveable inwardly towards the mounting frame and towards the engaged position or outwardly away from the mounting frame towards a released position with rotation of the pivot shaft about its upright vertical axis. A crank 90 is fixed onto the pivot shaft at an intermediate location with the free end of the crank being coupled to the cross bar by a suitable biasing member 92 which biases rotation of the pivot shaft to correspond to movement of the pawl from the released position towards the engaged position.

A release cable 94 is provided which is anchored to the pawl 80 at one end and which spans substantially the height of the mounting frame so that even in the raised position a user adjacent the bottom end of the mounting frame can readily grasp the opposing second end of the release cable. Pulling the release cable causes the pawl to be pivoted away from the engaged position towards the released position against the action of the biasing member 92 to allow downward movement of the carriage relative to the mounting frame only as long as the user maintains tension on the release cable.

The vehicle dolly includes a frame which extends in the longitudinal direction between a front end 100 and a rear end 102. A front frame member 104 spans perpendicularly to the longitudinal direction at the front end and a rear frame member 106 spans perpendicularly to the longitudinal direction at the opposing rear end. Two rails 108 are fastened adjacent opposing ends thereof in an overlapping configuration with the respective front and rear frame members by orienting the two rails to extend in the longitudinal direction. Mounting apertures are provided in each of the front and rear frame members for mounting the rails thereon at different spacings corresponding to different configurations.

Figure 13:
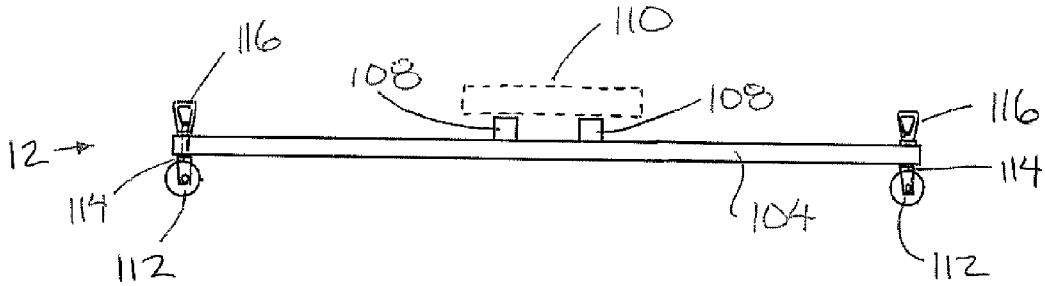
FIG. 13 is a front elevational view of the dolly frame in the first configuration.

In a first mounting configuration shown in FIG. 13, the two rails are mounted at a first prescribed spacing nearer to one another than the opposing ends of the frame members. In this manner a single elongate panel 110 is provided which spans the full length of the rails for overlapping both rails and commonly defining a single track upon which wheels of a motorcycle may be rolled onto. The elongate panel 110 may comprise a commercially available piece of lumber, for example a 2×10 construction member. The panel is fastened through apertures spaced apart in the longitudinal direction of the rails.

Figure 14:
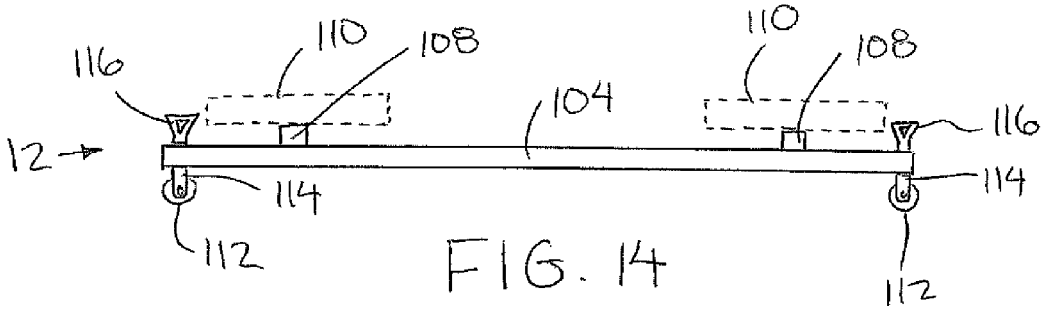
FIG. 14 a front elevational view of the dolly frame in the second configuration.
Figure 15:
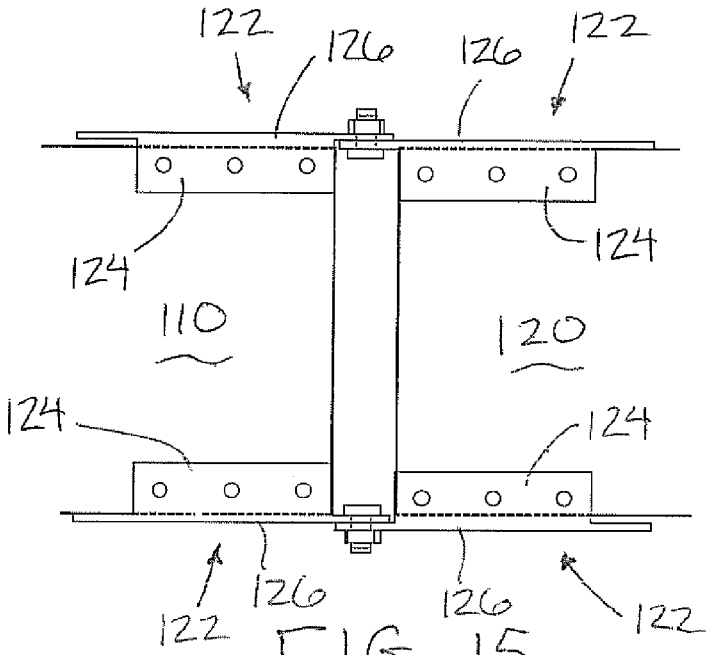
FIG. 15 is a bottom plan view of the hinge elements connecting one of the ramp sections of the vehicle dolly.
Figure 16:
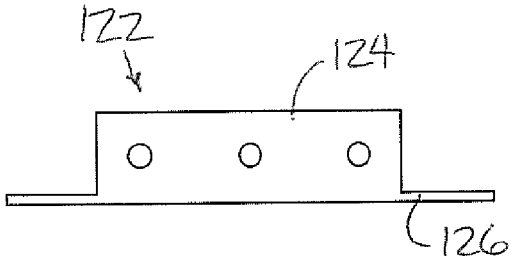
FIG. 16 is a bottom plan view of one of the hinge elements.
Figure 17:
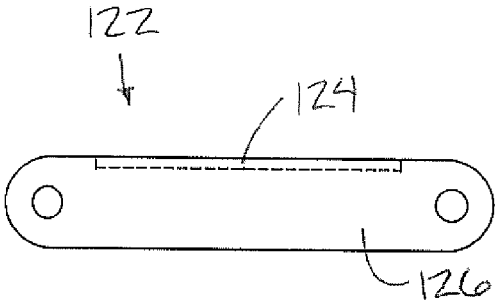
FIG. 17 is a side elevational view of one of the hinge elements.
Figure 18:
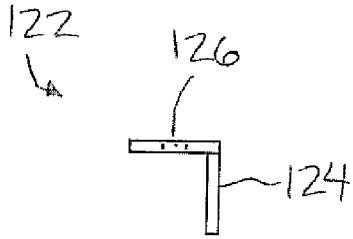
FIG. 18 is an end elevational view of one of the hinge elements.

In a second configuration shown in FIG. 14, the two rails are mounted at a second prescribed spacing greater than the first spacing and greater than the width of the elongate panel such that the two rails are mounted closer to the ends of the frame members than one another. In this instance, each rail mounts a respective panel 110 thereon so that the two rails define a pair of tracks respectively receiving respective wheels of a dual track vehicle thereon such as an all terrain vehicle.

The front and rear frame members are supported on castor wheels 112 having respective vertical axis pivot assemblies 114. Each end of each of the frame members is mounted in an overlapping configuration overtop of a respective one of the pivot assemblies of a respective castor wheel. In this arrangement the wheels are provided at a sufficient spacing between front and rear ends that the forks of the lift frame can be readily received therebetween. By further overlapping the rails on top of the front and rear frame members which are in turn mounted in overlapping configuration overtop of the pivot assemblies of the castor wheels, a sufficient height is provided to the rails to provide clearance therebelow for receiving the lift frame in use.

The vehicle dolly further comprises a set of tie-down loop anchors 116 in which each anchor comprises a rigid loop having a threaded connector which is arranged to be secured onto a common fastener which secures a respective one of the castor wheels 112 to the respective frame member.

Typically, the castor wheels are mounted at the opposing ends of the respective frame members in either configuration. When using the first configuration with a single track, the front and rear frame members can be shortened in the lateral direction. A set of auxiliary apertures 118 are provided spaced inwardly from each of the ends of each frame member for accommodating the fasteners which commonly mount the castor wheels and the loop anchors 116 onto the respective frame members so that the wheels can be mounted at a narrower spacing when shortening the frame members.

Each of the panels 110 forming either a single track or a pair of tracks is provided with a ramp 120 at the rear end thereof. Each ramp can be formed from the same commercially available wooden piece of lumber, for example a 2×10. A set of four hinge elements 122 is used to attach each ramp 120 to the respective panel 110.

Two hinge elements 122 are mounted on the end of each of the ramp 120 and the panel 110 at the pivotal connection therebetween. The two hinge elements on each of the ramp 120 and the panel 110 are mounted adjacent respective opposing longitudinally extending sides thereof. Each hinge element 122 includes a mounting flange 124 overlapping the bottom side of the respective ramp or panel and a hinge flange 126 fixed to the mounting flange in perpendicular arrangement therewith for extending upwardly along the respective side of the respective ramp or panel. Fastener apertures in the mounting flange 124 allow suitable fasteners to be used to secure the mounting flange to the bottom side of the ramp or panel adjacent the end thereof. The hinge flange 126 includes a projection at each end thereof which projects in the longitudinal direction beyond the end of the mounting flange. Accordingly at the end of each of the ramp 120 and the panel 110 the hinge flanges define a pair or projections projecting beyond the end of the panel or ramp towards the other one of the panel or ramp in overlapping engagement with corresponding hinge flanges of the other hinge elements. Hinge apertures in the projecting portions of the hinge flange allow fasteners to join the projecting portions together at both sides of the ramp and board to define a common hinge axis extending in the lateral direction.

In use, a user assembles the vehicle dolly in the first or second configuration according to the type of personal vehicle desired to be stored thereon. Commercially available lumber is used to form the panels and the ramps 120 connected thereto. Once a personal vehicle is driven onto the track or tracks, tie down straps are anchored to the anchors 116 for securing the personal vehicle relative to the dolly. The personal vehicle can then be stored in a raised position by lowering the carriage to the lowered position adjacent the ground and loading of the dolly onto the lift carriage. The configuration of the dolly allows rolling movement in a lateral direction so as to permit orientation of the rails extending in the lateral direction of the carriage across the two rails of the lifting frame. Subsequent lifting of the carriage relative to the mounting frame by operating the winch causes the two rails of the vehicle dolly to be supported at spaced apart positions spanning across the two rails of the lifting frame.

As the carriage is raised towards the raised position, the track followers roll along respective bearing surfaces of the tracks while the guide followers roll along opposing sides of the guide flange to maintain alignment of the track followers with the track at top and bottom ends respectively. Continued operation of the winch is permitted until the limit switch on the carriage engages the corresponding stop on the mounting frame at which point operation of the winch ceases and the carriage remains in the raised position. Throughout the lifting motion, the ratchet mechanism remains in the engaged position with the pawl riding over the inclined ramped surfaces of the projections of the rack. In the raised position, the pawl is aligned overtop of an uppermost one of the latching surfaces of the rack to prevent downward movement of the carriage relative to the mounting frame even in the event of failure of the winch.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A lifting device in combination with an upright supporting surface and a vehicle dolly for a personal vehicle wherein the vehicle dolly comprises a dolly frame including at least one wheel track extending in a longitudinal direction between opposing ends of the dolly frame supported on wheels such that said at least one wheel track of the dolly frame is supported spaced above the ground for rolling movement along the ground by the wheels in which said at least one wheel track is arranged for receiving wheels of the personal vehicle rolled thereon, the lifting device comprising:

a mounting frame defining a vertical mounting plane which is mounted parallel against said upright supporting surface;

at least one lifting track extending vertically along the mounting frame, said at least one lifting track comprising an inner bearing surface and an outer bearing surface which are supported on the mounting frame so as to be substantially parallel to the upright supporting surface and such that the inner bearing surface faces the upright supporting surface and the outer bearing surface faces away from the upright supporting surface;

a carriage supported for movement along said at least one lifting track between a lowered position in which a bottom end of the carriage is adjacent to a bottom end of the mounting frame and a raised position in which the bottom end of the carriage is spaced upwardly from the bottom end of the mounting frame;

a lift frame fixed on the carriage for movement therewith along said at least one lifting track, the lift frame extending generally horizontally outward from the bottom end of the carriage so as to be arranged to be received between said at least one wheel track and the ground at a location between the wheels at the opposing ends of the dolly frame in the lowered position;

a guide flange extending vertically along the mounting frame and being oriented transversely to the bearing surfaces of said at least one track;

an upper track follower supported adjacent a top end of the carriage and being arranged for riding along the inner bearing surface;

a lower track follower supported adjacent a bottom end of the carriage and being arranged for riding along the outer bearing surface;

a pair of upper guide followers supported adjacent the top end of the carriage and being arranged for riding along opposing sides of the guide flange; and a pair of lower guide followers supported adjacent the bottom end of the carriage and being arranged for riding along the opposing sides of the guide flange.

2. The combination according to claim 1 wherein the lift frame comprises a pair of parallel and spaced apart rails extending perpendicularly outwardly from the mounting frame so as to define a lifting fork arranged for supporting a pallet thereon.

3. The combination according to claim 1 wherein said at least one lifting track comprises a pair of lifting tracks along opposing sides of the mounting frame.

4. The combination according to claim 1 wherein there is provided a winch fixed to the carriage for movement therewith relative to the mounting frame and a winch cable wound onto the winch at a first end, the winch cable extending over an upper pulley supported on a top end of the mounting frame and being anchored at a second end opposite the first end wound onto the winch.

5. The combination according to claim 1 wherein there is provided a ratchet mechanism including a plurality of latching surfaces spaced apart in a vertical direction on the mounting frame to define a rack and a pawl pivotally supported on the carriage for pivotal movement between a locking position in which the pawl is arranged for selective engagement with the latching surfaces of the rack such that only downward movement of the carriage relative to the mounting frame is prevented and a released position in which the pawl is prevented from engaging the latching surfaces of the rack, the pawl being biased towards the locking position and wherein there is provided a release cable coupled to the pawl at a first end and being suspended from the carriage such that pulling an opposing second end of the release cable displaces the pawl into the released position.

6. The combination according to claim 1 wherein the dolly frame comprises:

a front frame member spanning perpendicularly to the longitudinal direction at the front end of the dolly frame;

a rear frame member spanning perpendicularly to the longitudinal direction at the rear end of the dolly frame; and a pair of rails extending in the longitudinal direction between the front frame member and the rear frame member so as to define said at least one wheel track;

the wheels being supported on each of the front and rear frame members at spaced apart positions so as to be arranged to support the dolly frame for rolling movement along the ground;

the pair of rails being arranged to be mounted on the front and rear frame members at a first prescribed spacing so as to be arranged to define a single track arranged to receive wheels of a motorcycle driven thereon; and the pair of rails being arranged to be mounted on the front and rear frame members at a second prescribed spacing so as to be arranged to define a pair of tracks arranged to receive wheels of a personal all terrain vehicle driven thereon.

7. The combination according to claim 6 wherein the pair of rails extend overtop of the front and rear frame members in an overlapping configuration therewith and wherein the wheels comprise caster wheels having upright pivot assemblies overtop of which the front and rear frame members are supported.

8. The vehicle dolly according to claim 7 wherein there is provided a pair of tie down anchor loops secured to each of the front and rear frame members, each anchor loop being secured to the respective frame member by a common fastener with a respective one of the caster wheels.

9. The combination according to claim 6 further comprising a pair of elongate panels wherein each rail is arranged to support a respective one of the elongate panels extending along a length thereof in the longitudinal direction in the second prescribed spacing of the rails to define the pair of tracks and wherein the rails are arranged to commonly support one of the elongate panels extending therealong in the longitudinal direction in the first prescribed spacing of the rails to define the single track.

10. The combination according to claim 1 wherein the upper and lower track followers comprise wheels supported for rolling movement along the respective bearing surfaces.

11. The combination according to claim 1 wherein the upper and lower guide followers comprise wheels supported for rolling movement along the respective sides of the guide flange.

12. The combination according to claim 11 wherein the guide followers are adjustable relative to the carriage frame in a generally horizontal direction arranged to extend substantially parallel to the upright supporting surface.

13. The combination according to claim 1 wherein said at least one lifting track comprises a U-shaped channel defined by a first flange defining the inner bearing surface, a second flange defining the outer bearing surface and a base flange joined between the first and second flanges.

14. The combination according to claim 1 wherein said at least one track comprises a pair of tracks extending along opposing sides of the mounting frame.

15. The combination according to claim 1 wherein the lift frame comprises a pair of parallel and spaced apart rails extending perpendicularly outwardly from the mounting frame so as to define a lifting fork arranged for supporting a pallet thereon.

* * * * *